United States Patent [19]

Swanson

[11] 4,280,969

[45] Jul. 28, 1981

[54] CARBURETOR

[76] Inventor: Wilbur M. Swanson, 2301 Parkridge Ave., St. Louis County, Mo. 63144

[21] Appl. No.: 960,466

[22] Filed: Nov. 13, 1978

Related U.S. Application Data

[62] Division of Ser. No. 723,979, Sep. 16, 1976, Pat. No. 4,139,581.

[51] Int. Cl.[3] ..... F02M 9/04

[52] U.S. Cl. ..... 261/62; 261/DIG. 78; 261/DIG. 56; 261/78 R

[58] Field of Search ..... 261/DIG. 78, 78 R, 62, 261/DIG. 56, 50 A

[56] References Cited

U.S. PATENT DOCUMENTS

| | | | |
|---|---|---|---|
| 1,134,365 | 4/1915 | Barnes | 261/DIG. 56 |
| 1,152,173 | 8/1915 | Haegele | 261/40 |
| 1,427,910 | 9/1922 | Quinn | 261/78 R |
| 1,441,992 | 1/1923 | Meden | 261/62 |
| 1,607,052 | 11/1926 | Brinkman | 261/62 |
| 1,969,638 | 8/1934 | Culp | 261/DIG. 78 |
| 1,979,918 | 11/1934 | Wahlmark | 261/78 R |
| 2,052,225 | 8/1936 | Hartshorn | 261/DIG. 56 |
| 2,574,670 | 11/1951 | Sweeney | 261/50 A |
| 2,726,073 | 12/1955 | Seld | 261/DIG. 78 |
| 2,793,845 | 5/1957 | Brown | 261/121 A |
| 3,143,401 | 8/1964 | Lambrecht | 261/DIG. 68 |
| 3,182,974 | 5/1965 | Hill | 261/50 A |
| 3,336,013 | 8/1967 | Salo | 261/62 |
| 3,759,499 | 9/1973 | Lang | 261/DIG. 78 |
| 3,778,038 | 12/1973 | Eversole et al. | 261/DIG. 78 |
| 3,953,548 | 4/1976 | Knapp et al. | 261/DIG. 78 |
| 4,000,225 | 12/1976 | Heilig et al. | 261/DIG. 78 |
| 4,001,356 | 1/1977 | Graybill | 261/62 |
| 4,034,028 | 7/1977 | Ma | 261/DIG. 78 |
| 4,056,583 | 11/1977 | Shinoda et al. | 261/DIG. 78 |
| 4,065,526 | 12/1977 | Englert et al. | 261/DIG. 78 |

FOREIGN PATENT DOCUMENTS

| | | | |
|---|---|---|---|
| 2219880 | 10/1973 | Fed. Rep. of Germany | 261/DIG. 56 |
| 2654988 | 6/1977 | Fed. Rep. of Germany | 261/DIG. 78 |
| 532397 | 2/1922 | France | 261/121 B |
| 270012 | 12/1929 | Italy | 261/62 |
| 145226 | 7/1920 | United Kingdom | 261/62 |

*Primary Examiner*—Tim R. Miles

*Attorney, Agent, or Firm*—Kalish & Gilster

[57] ABSTRACT

A carburetor which comprises a casing, an air inlet at the upper end thereof and an air-fuel mixture discharge at the lower end thereof, with a venturi throat located downwardly of said inlet, a sonic throat below said venturi throat, and a diffuser section interconnecting the sonic throat and the discharge. Portions of the wall of the sonic throat are provided with a plurality of indentations, projections, or surface irregularities for stabilizing the flow therethrough and conducing to the uniformity of the air-fuel mixture. At least one portion of said sonic throat is movable with respect to the fixed portions of said throat for altering the cross-section thereof responsive to fuel requirements for combustion.

2 Claims, 32 Drawing Figures

CARBURETOR

This is a division of application Ser. No. 723,979 filed Sept. 16, 1976, now U.S. Pat. No. 4,139,581.

BACKGROUND AND SUMMARY OF THE INVENTION

This invention relates in general to carburetors for internal combustion engines and, more particularly, to carburetors incorporating sonic throats.

Many efforts have been made to design a sonic throat carburetor which will effectively produce a better fuel-air mixture and a more even mixture flow to the cylinders of internal combustion engines than carburetors of conventional design. One of the primary reasons for the lack of success of adapting the sonic principle to carburetors is believed to be the inability of providing flow stability in the diffuser section downstream of the sonic throat. Considerable difficulty is customarily encountered in obtaining a stable flow in the diffuser section since the flow will normally tend to separate from one circumferential or transverse zone immediately downstream of the sonic throat to the next succeeding zone and thereby cause exceedingly large nonuniformities in the diffusing flow. Thus, undesired instabilities, such as nonuniform flow, pulsating flow, and nonuniform fuel air mixtures are caused.

The present invention overcomes these recognized disadvantages by providing a carburetor having a sonic throat, but wherein the components defining such throat may be relatively moved, one with respect to the other, for altering the cross section of the throat in correspondence to the power requirements as the carburetor throttle is actuated from an idle position. Additionally, the components defining the sonic throat are provided with a multiplicity of indentations, projections, or surface irregular zones, producing a pattern of small, interlaced, and interacting shock waves conducing to stability of flow in the diffuser section, said waves thus effecting a smooth transistion from supersonic to subsonic flow. The incorporated indentations, projections, or surface irregularities will bring about a flow stability together with a more uniform air fuel mixture and thereby overcome the drawbacks which have been posing a continual problem to the use of sonic throat carburetors to the present time.

Therefore, it is an object of the present invention to provide a carburetor incorporating a sonic throat which is adapted to promote stability of flow in the diffuser section.

It is another object of the present invention to provide a carburetor of the character stated which incorporates uniquely adapted components for altering the cross section of the carburetor throat responsive to particular power requirements of the associated engine at a given juncture.

It is a further object of the present invention to provide a carburetor of the character stated which embodies novel improvements to sonic throat-defining surfaces for creating zones of turbulence to facilitate the transistion of flow from supersonic to subsonic and which promote a substantially uniform air-fuel mixture.

It is another object of the present invention to provide a carburetor of the type stated which is adapted to eliminate pulsating flow within the diffuser section.

It is a still further object of the present invention to provide a carburetor of the type stated which is capable of delivering a uniformly mixed, finely atomized air-fuel mixture to the intake manifold of the associated engine whereby a stoichemetric air-fuel mixture may be used thereby minimizing pollution problems and optimizing fuel consumption.

It is another object of the present invention to provide a carburetor which is of relatively simple construction; and may be produced most economically; and which is highly durable and reliable in operation.

It is an additional object of the present invention to provide a carburetor of the character stated which incorporates a component concurrently acting as one boundary of the sonic throat and serving as an accelerator pump thereby producing a highly integrated carburetor.

DESCRIPTION OF PRACTICAL EMBODIMENTS

Figure 1:
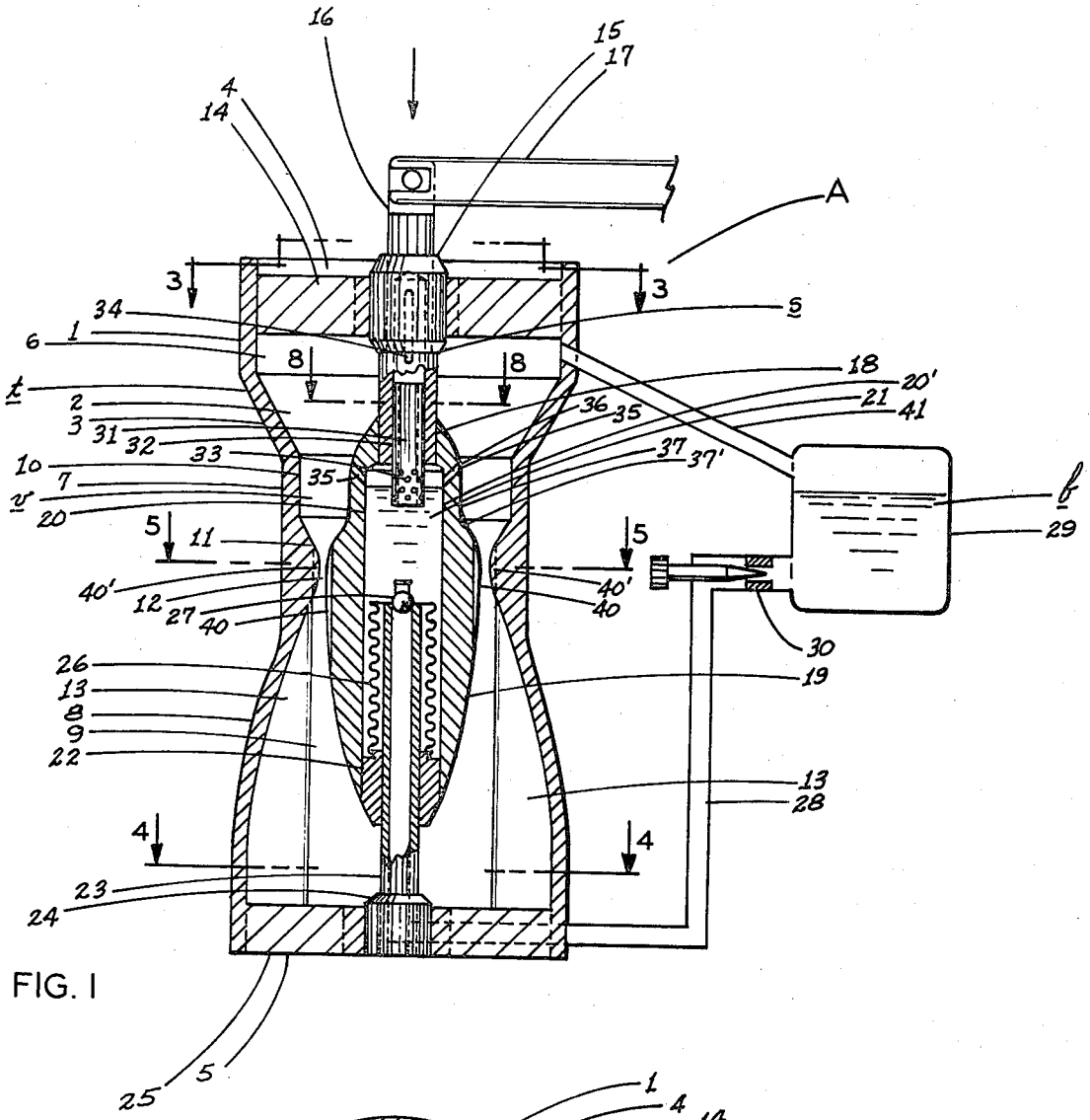
FIG. 1 is a vertical cross-sectional view of a carburetor constructed in accordance with and embodying the present invention illustrating the same in idle position.
Figure 3:
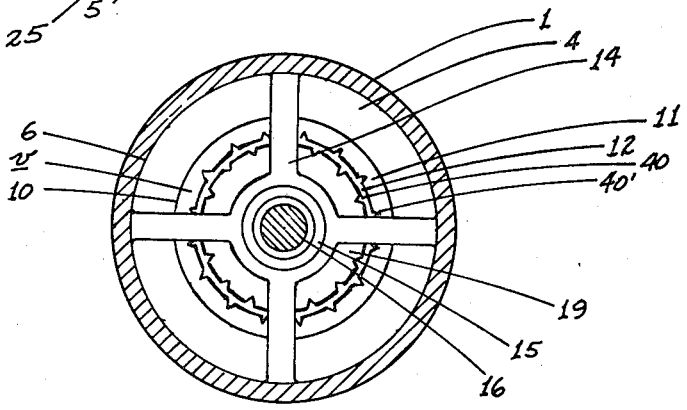
FIG. 3 is a plan view taken on the line 3—3 of FIG. 1.

Referring now by reference characters to the drawings which illustrate practical embodiments of the present invention, A designates a down draft carburetor of the sonic throat type comprising a casing 1 of general tubular character, having a bore designated broadly at 2 as defined in a continuous side wall 3; said casing 1 being open at its upper and lower ends to provide an air inlet 4 and a fuel-air mixture discharge 5, respectively. Side wall 3 is externally contoured to provide at its upper end, adjacent air inlet 4, a substantially wide cylindrical air introductory portion 6 and then is tapered radially inwardly, as at t, to a diametrally reduced, relatively narrow waist section 7. Below waist 7 side wall 3 flares downwardly and outwardly to define the wall 8 of a diffuser section 9. Internally, waist section 7, in its upper portion, as at 10, is of relatively constant diameter but of substantially less extent than that of air introductory portion 6 to constitute the outer side of a venturi metering throat v; and in its lower portion said waist 7 is inclined inwardly and downwardly to a protrusion 11 constituting the outer limit of a sonic throat 12 or zone of minimum cross-section to conduce to air flow therethrough at sonic speed. From protrusion 11 waist 7 interiorly inclines outwardly and downwardly for merging with the inner face of diffuser section wall 8. Within diffuser section 9, there is presented a series of circumferentially spaced apart vanes 13, as at 90° intervals, which are rigid along the outer edges thereof with wall 8 and with the inner edges thereof being located slightly outwardly of alignment with protrusion 11 or the outer limit of sonic throat 12.

Fixed in air introductory portion 6 of casing 1 is a spider 14 centrally containing a bearing 15 for a vertically shiftable, control rod 16 coaxial with casing bore 2; said shaft 16 projecting at its upper end beyond casing 1 for pivotally engaging one end of a link 17 of a throttle control linkage (not shown) whereby up and down movement of said shaft 16 may be effected for purposes presently appearing.

Downwardly of bearing 15, shaft 16 is diametrally increased to form an annular, upwardly presented stop shoulder s for abutment against the confronting under face of bearing 15 to limit upward shifting of shaft 16. At its lower end shaft 16 is engaged within the bore 18 at the upper end of a plug 19 having a counter-bore 20, the wall 20' of which defines a chamber 21. Counterbore 20 is normally open through its opposite or lower end within which is secured a bearing sleeve 22 disposed surroundingly of, in relatively slideable relationship with respect to, a vertical fuel inlet tube 23. Tube 23 projects upwardly into chamber 21 and at its lower end is spaced downwardly from plug 19 and fixedly engaged within a bearing 24 centrally of a spider 25 extending across the discharge 5 of casing 1. Surrounding fuel inlet tube 23, upwardly of sleeve 22 is a bellows spring 26 which, at the lower end thereof, is fixed to said sleeve 22 and thereby to plug 19; and at the upper end thereof is suitably anchored to the upper end portion of tube 23; the normally open upper end of tube 23 provides a seat for a check valve 27. Fuel inlet tube 23 is connected by a conduit 28 to a fuel chamber 29 through a conventional needle valve 30 depicted schematically. It will be seen that fuel inlet tube 23 serves as a guide for plug 19 in that upon actuation of the throttle linkage to depress shaft 16, plug 19 will move relatively downwardly along tube 23 placing bellows spring 26 under stress and, concurrently, for reasons to be clarified shortly, reducing the volume of chamber 21 upwardly of the upper end of said tube 23.

Extending downwardly into chamber 21 of plug 19 is the lower end of a pilot air pipe 31 received within a bore 32 formed in the lower part of shaft 16. Pipe 31 adjacent its lower end is provided with a multiplicity of apertures 33 which communicate with ambient air through a vertically extending, relatively narrow slot 34 formed in shaft 16 in the upper portion of bore 32 thereof. Slot 34 is normally substantially occluded by bearing 15 so that the extent of exposure of said slot 34 is determined by the relative position of shaft 16 with respect to said bearing 15 whereby as said shaft 16 is depressed an increased portion of slot 34 is exposed to allow for introduction of air into pipe 31 for discharge through apertures 33 into chamber 21 for reasons to be shown below.

Connecting chamber 21 with the interior of casing 1 is a series of aspirating ports 35 formed in the wall 20' of plug 19 adjacent the upper end of chamber 21; said ports 35 inclining upwardly and outwardly from said chamber 21 with the outer ends thereof, as at 36, opening into venturi metering throat v. Plug 19 in its upper portion, as at 37, is externally contoured complementarily to the normally confronting or opposed upper portion 10 of waist 7 of carburetor casing side wall 3 for defining the inner limit of venturi metering throat v, and immediately downwardly thereof said plug 19 protuberates, as at 37', to constitute the inner boundary of sonic throat 12. Below protuberation 37' plug 19 gently tapers inwardly toward its lower end so as to cause the internal volume of diffuser section 9 to be enlarged toward fuel-air mixture discharge 5.

Plug 19, as shown in FIG. 1, is in its uppermost position by reason of the abutment of shoulder s against bearing 15 and in such position throat 12, which is designed for sonic (critical or choked) flow is of minimal area. Upon actuation of throttle linkage 17 for causing downward shifting of shaft 16 to meet the particular demand for engine performance, plug 19 will descend thereby producing an alteration in the throat area or clearance gap. It is to be understood that the minimum area of throat 12, in accordance with well known considerations, is particularly adapted for a specific engine displacement and idling power requirement and may be easily altered for variations in engine size or idle power requirements. However, as pointed out, as the engine speed or power is increased by the downward shifting of shaft 16, the minimum critical area of throat 12 is increased for accommodating the increased air flow with the entrained fuel.

Formed on the outer face of plug 19 in the portion thereof opposingly of casing protrusion 11, that is, as providing the inner boundary of sonic throat 12, there is provided a series of circumferentially spaced, vertically extending slots or indentations 40. Optionally, a like series of indentations 40' may be formed on casing wall 1 within the zone of protuberance 11 desirably in offsetting relationship to plug indentations 40.

Carburetor A at the lower end thereof is connected to a conventional intake manifold (not shown) which latter leads to the combustion chambers of cylinders of an internal combustion engine via the usual intake valves, none of which is shown as the same are of current character and do not form a part of the present invention.

With carburetor A in idle position with sonic throat 12 at its minimal area, as shown in FIG. 1, fuel f, as gasoline, will be at a level within chamber 21 of plug 19 immediately below aspirating ports 35. It is to be observed that fuel flows from fuel chamber 29 through conduit 28 and into inlet tube 23, with said chamber 29 being disposed relative to plug 19 to assure that the level in chamber 21 is below ports 35 when carburetor A is in idle position. Fuel chamber 29 is connected to the upper or intake end of carburetor A by means of an air vent tube 41. It is preferable that air vent tube 41 opens at the upper end thereof flush at the air inlet 4 of carburetor A in order to prevent obstruction or disturbance of flow of the admitted air.

Upon depression of shaft 16 under operation of throttle linkage 17, plug 19, as stated, is moved downwardly within casing 1 thereby decreasing the internal volume of chamber 21 (see FIG. 2) and thereby presenting an accelerator pump effect by reason of forcing fuel f outwardly through aspirating ports 35; valve 27 preventing back flow into flow chamber 29. Such pumping action by plug 19 augments the fuel aspirated through said ports 35 by the increased air flow in venturi metering throat v. It is understood that the extent of such fuel augmentation by pumping action of plug 19 is determined by the effective piston size of bellows spring 26. At low acceleration rates it is preferable not to pump the entire displaced volume determined by the piston size and the rate of such fuel augmentation may be controlled by using a fluted check valve with an orifice, or a ball check valve with by-pass grooves in the seat therefor.

By such operation of the throttle linkage, an increased air intake is effected through carburetor inlet 4 and with the velocity of such flow being increased as the same moves through the constriction of venturi metering throat v whereby the attendant reduction in pressure will cause fuel f to be drawn outwardly through ports 35 in particle form for further atomization by the accelerated air flow. The accelerating pump action of plug 19 will assure of the additional fuel to the air flow to compensate for any lagging of the fuel and thereby promote an effective fuel-air ratio. The size and number of ports 35, together with the contour of venturi metering throat v, are designed to produce a constant stoichemetric fuel-air ratio at all constant operating conditions so that the accelerating pump action of plug 19 compensates only upon the sudden quick operation of throttle linkage 17 for rapid acceleration or extra power. Normally, four ports 35 as described will provide an even fuel distribution around the circumference of plug 19 and provide uniform fuel mixture to the intake manifold. Said ports 35, as stated, incline upwardly to provide a longer fuel injection path into the air stream and thereby conduce to improved initial dispersion, atomization, and evaporation. The formation of said ports 35 at an angle with a radius may provide improved dispersion. The inclination of said ports 35 as well as the cross-sections thereof are designed to provide a fuel flow momentum therethrough of such magnitude that the fuel is deviated and dispersed by the air stream without impingement on the outer wall of venturi metering throat v and at the same time prevent spilling or dribbling down the outer face of plug 19. The novel plug 19 of the present invention causes the ejection of fuel into the air stream for an optimum air-fuel ratio, as well as for promoting the distribution of such fuel within the air stream and without contacting the boundaries of throat v, with atomization and evaporation being markedly enhanced.

Figure 2:
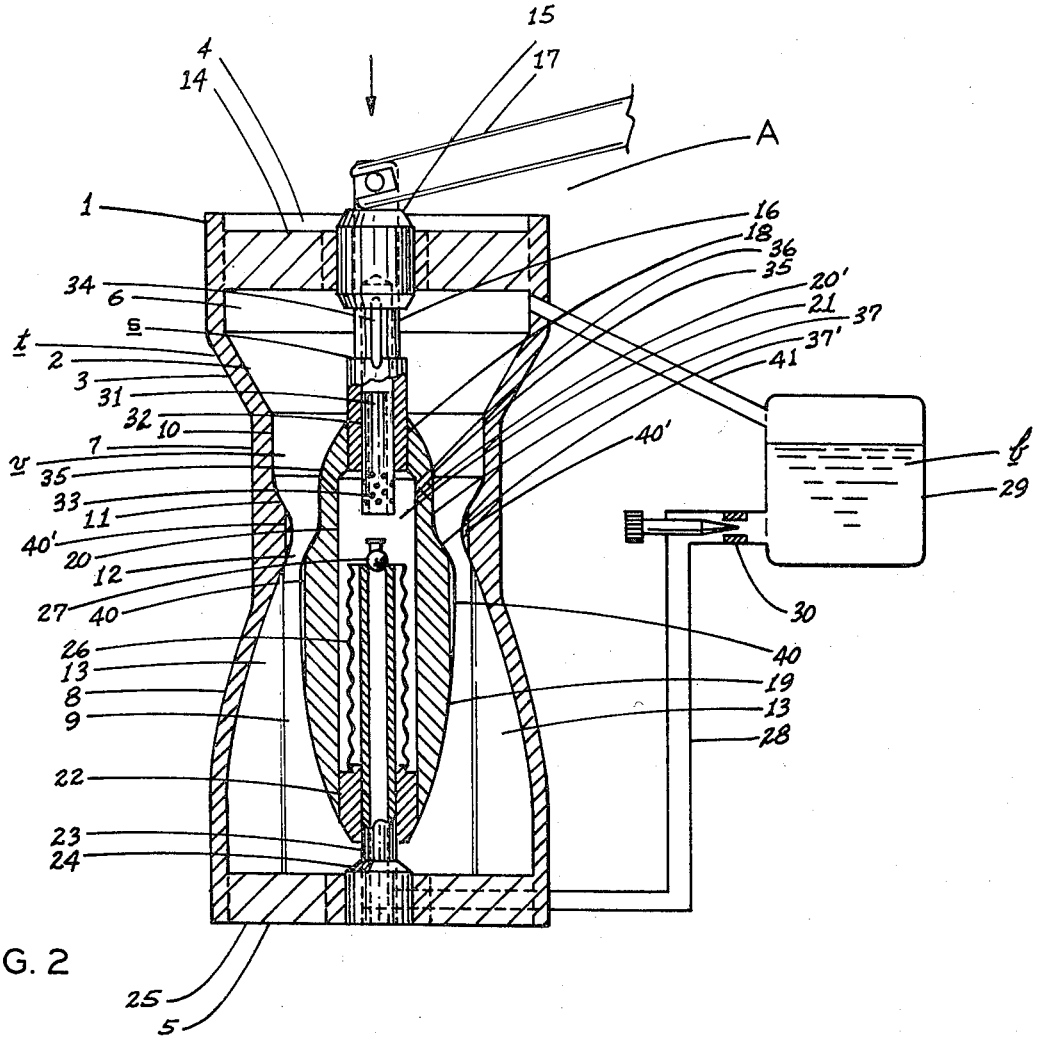
FIG. 2 is a vertical cross-sectional view of the carburetor shown in FIG. 1 illustrating the same in advanced throttle position.
Figure 4:
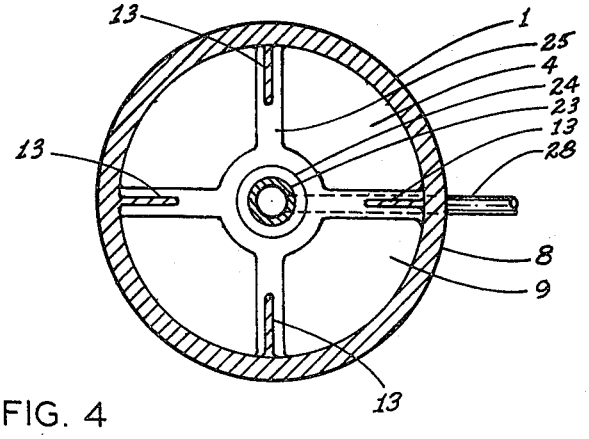
FIG. 4 is a horizontal transverse sectional view taken on the line 4—4 of FIG. 1.
Figure 5:
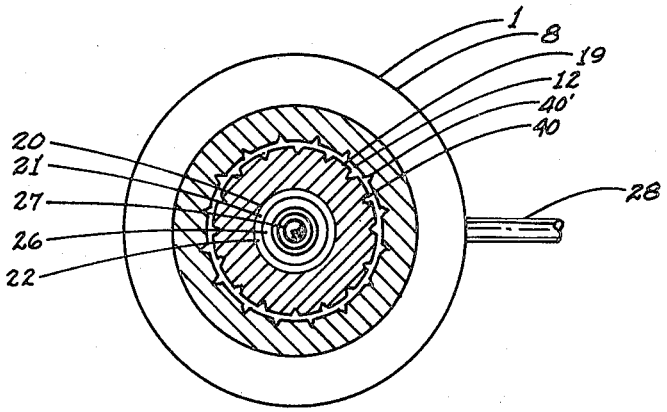
FIG. 5 is a horizontal transverse sectional view taken on the line 5—5 of FIG. 1.
Figure 6:
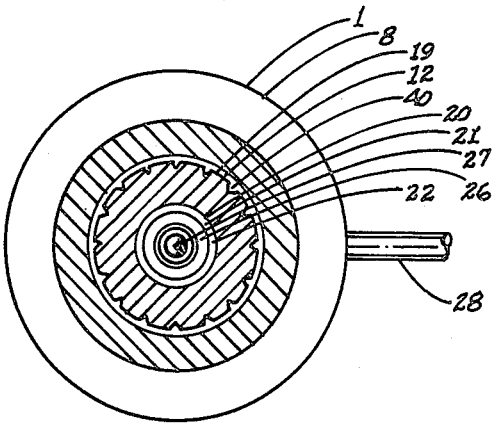
FIG. 6 is a horizontal transverse sectional view taken substantially on the line 5—5 of FIG. 1 illustrating the indentations only upon the plug.
Figure 7:
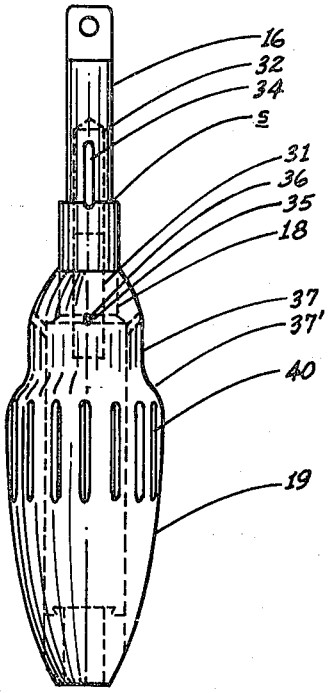
FIG. 7 is an exterior elevational view of the plug.
Figure 8:
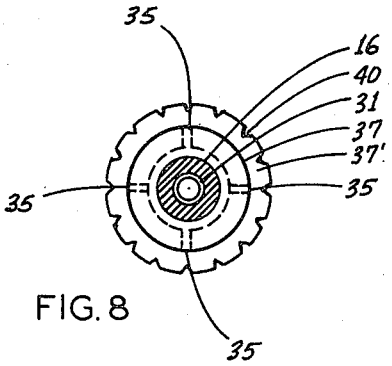
FIG. 8 is a partial horizontal transverse sectional view taken substantially on the line 8—8 of FIG. 1.

As the air-fuel mixture flows downwardly, the same will pass through sonic throat 12 which has been widened beyond its minimal area to accommodate the increased high velocity flow by reason of downward shifting of plug 19 (see FIG. 2). However, due to the generally restricted character of said throat 12 the mixture is subjected to a high degree of shear.

Under idling or low power cruise conditions of high manifold vacuum, the pressure across carburetor A is super-critical, producing sonic flow in throat 12 and with a region of super-critical or supersonic flow downwardly, that is, downstream of throat 12. The air-fuel flow, for appropriate engine operation, must be returned to a condition of subsonic flow within diffuser section 9 with the transistion from supersonic to subsonic flow causing a pattern of shock waves.

Indentations 40 on plug 19, which are of such length as to be presented within the throat and upper diffuser portion of said plug 19, will cause a pattern of small interlaced and interacting shock waves of greater stability than the shock pattern developed in a smooth-walled, annular, cylindrical, or rectangular slot nozzle diffuser configuration. The contour of wall 8 of diffuser section 9 cooperates with the exterior configuration of plug 19 to maintain flow attachment, by reason of the downwardly expanding volume defined therebetween, and thereby produce optimum pressure recovery in diffuser section 9 for maximum efficiency operation at low manifold vacuum, high engine output operating conditions. It is, of course, understood that turbulence in diffuser section 9 as caused by the contour thereof with relation to throat 12 will promote further mixing and evaporation of the entrained fuel f. However, with carburetors of the sonic throat type, customarily considerable difficulty is encountered in obtaining a stable flow in the diffuser section downwardly of the sonic throat 12 as the flow normally tends to separate from a transverse zone downstream of throat 12 and causes substantial nonuniformities in the diffuser section flow. Nonuniform, pulsating flows with the delivery of nonuniform air-fuel mixtures to the intake manifold are produced. In the present invention, such instabilities and nonuniformities are obviated by reason of indentations 40 in the outer side wall of plug 19, as said indentations serve as stabilization channels for the flow and act as labyrinth obstructions to circumferential or transverse flows. Indentations 40 have their main axis in the same direction as the flow and thus serve a dual function namely to conduce to the intermixture of the air and fuel as well as to stabilize the flow into diffuser section 9 to assure of avoidance of unstable and pulsating flow as well as avoidance of lack of uniformity of the air fuel mixture. However, the provision of a corresponding series of indentations 40' on protrusion 11 of casing side wall 3 which are in offset relationship to indentations 40, aid in promoting uniformity of mixture and flow stability.

Pilot air atomization is attained by operation of pilot air pipe 31 which through the exposed portion of slot 34 connects chamber 21 of plug 19 with the near ambient pressure, low velocity area of inlet 4. Thus, air will be drawn through said slot 34 into chamber 21 by reason of the differential in pressure between the aforesaid low velocity inlet 4 and venturi metering throat v. Such air will mix with the fuel f in chamber 21 and be ejected therewith through ports 35 into venturi metering throat v thereby enhancing both air fuel mixing and atomization. The pilot air flow is thus metered by slot 34 as the area thereof is increasingly exposed as shaft 16 is moved downwardly for engine operation.

Figure 9:
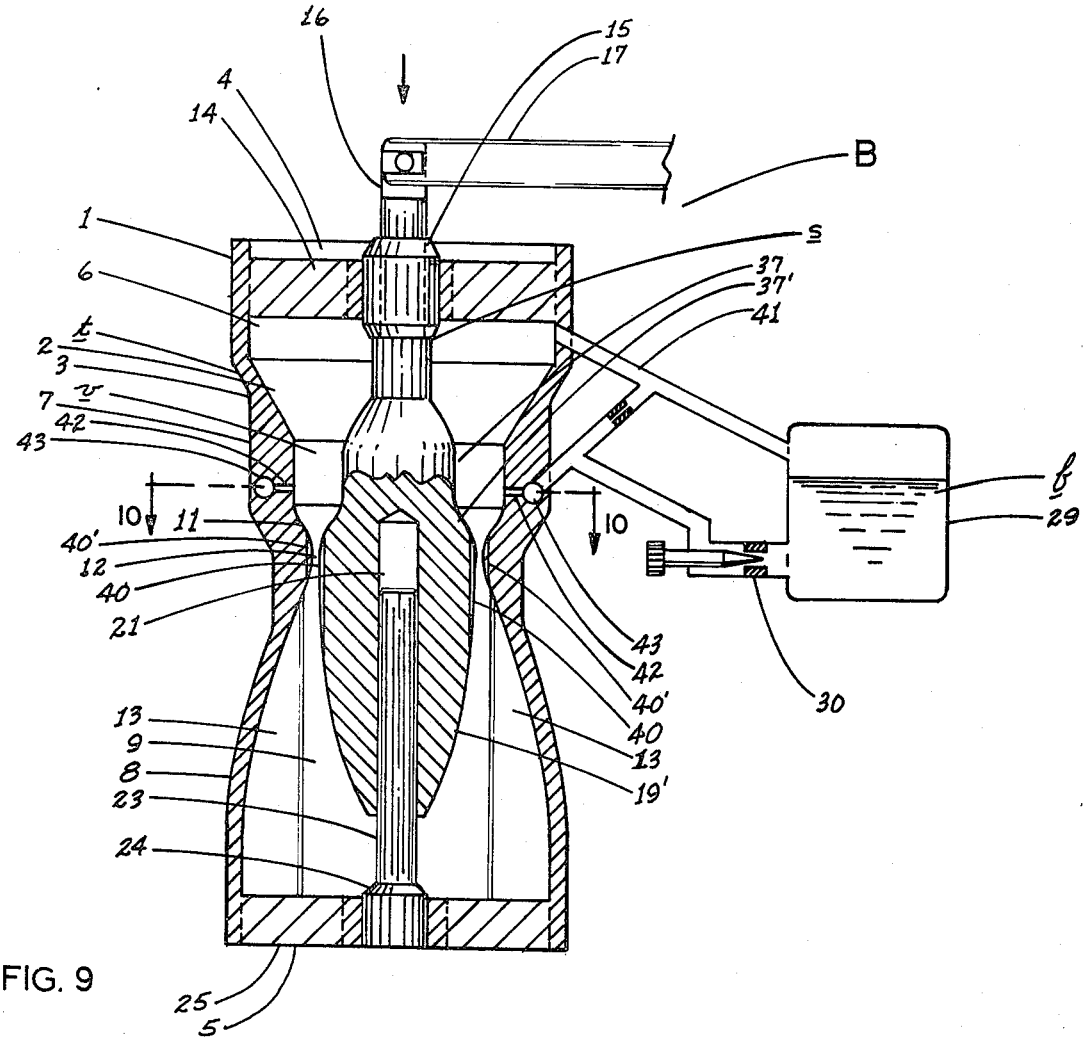
FIG. 9 is a vertical cross-sectional view of the carburetor shown in FIG. 1 but incorporating another form of fuel introduction.
Figure 10:
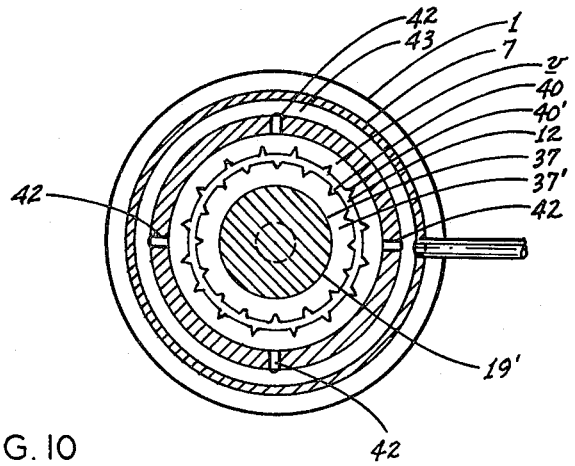
FIG. 10 is a horizontal transverse sectional view of another form of carburetor constructed in accordance with and embodying the present invention.

Referring now to FIG. 9, there is illustrated another form of carburetor, indicated B, which embodies the present invention, and for purposes of simplifying description, like components as those hereinabove set forth with respect to carburetor A will bear like reference numerals. Carburetor B includes a plug 19' which although having the same external contour as plug 19 above described, may be solid as it does not function as an accelerator pump in this embodiment nor serve as the primary outlet for fuel into venturi metering throat v. Thus, neither fuel f nor pilot air is supplied internally of plug 19', although said plug 19' is vertically shiftable with shaft 16 in the same manner as plug 19 in carburetor A for altering the area of sonic throat 12. Plug 19' also embodies indentations 40 for the same purposes as above described. Opening into carburetor casing side wall 3 in the upper portion of waist 7 and, hence, on the outer side of venturi metering throat v, is a series of circumferentially arranged fuel ejection ports 42 being connected at the outer ends thereof with a manifold 43 surrounding said carburetor B. Manifold 43 is in communication with fuel chamber 29 through an auxiliary conventional accelerator pump (not shown). Thus, carburetor B is designed to cause fuel to be injected into the venturi metering throat v through operation of the auxiliary accelerator pump as at the initial throttle action, as well as for normal fuel flow as under the suction created by the reduced pressure of the high velocity air flow. The stability of flow and uniformity of air-fuel mixture are brought about by indentations 40 alone or together with coordinating indentations 40', all as above set out.

Figure 11:
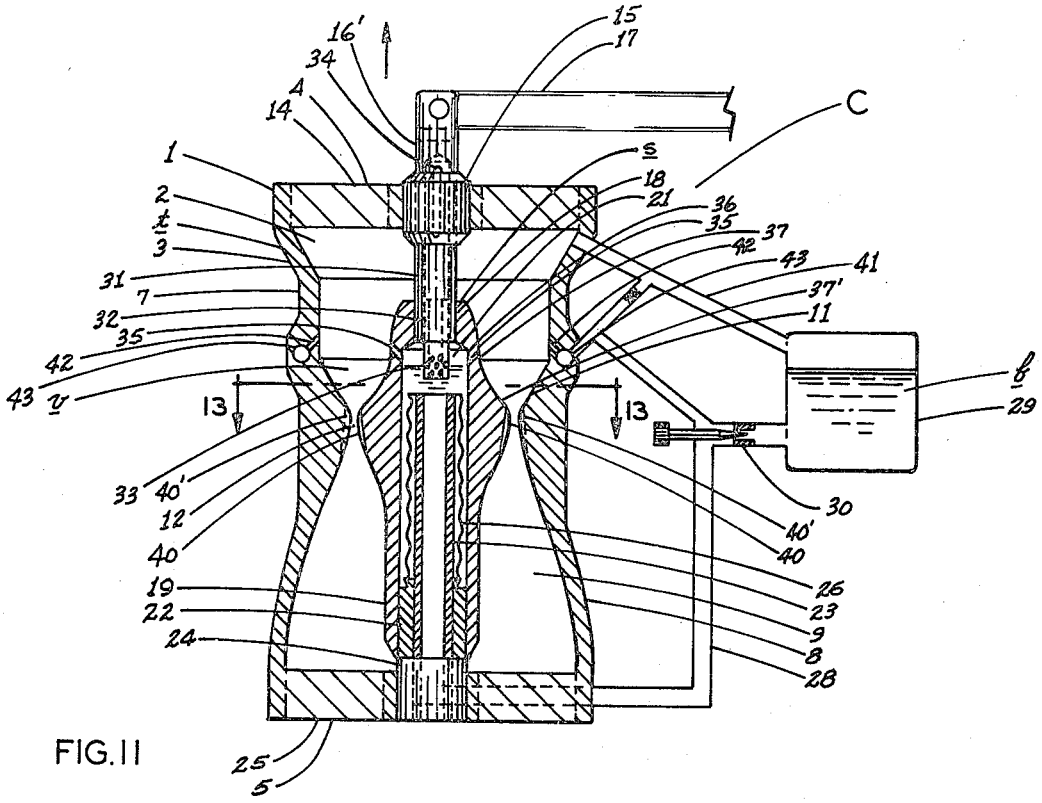
FIG. 11 is a vertical transverse sectional view of another form of carburetor constructed in accordance with and embodying the present invention.
Figure 12:
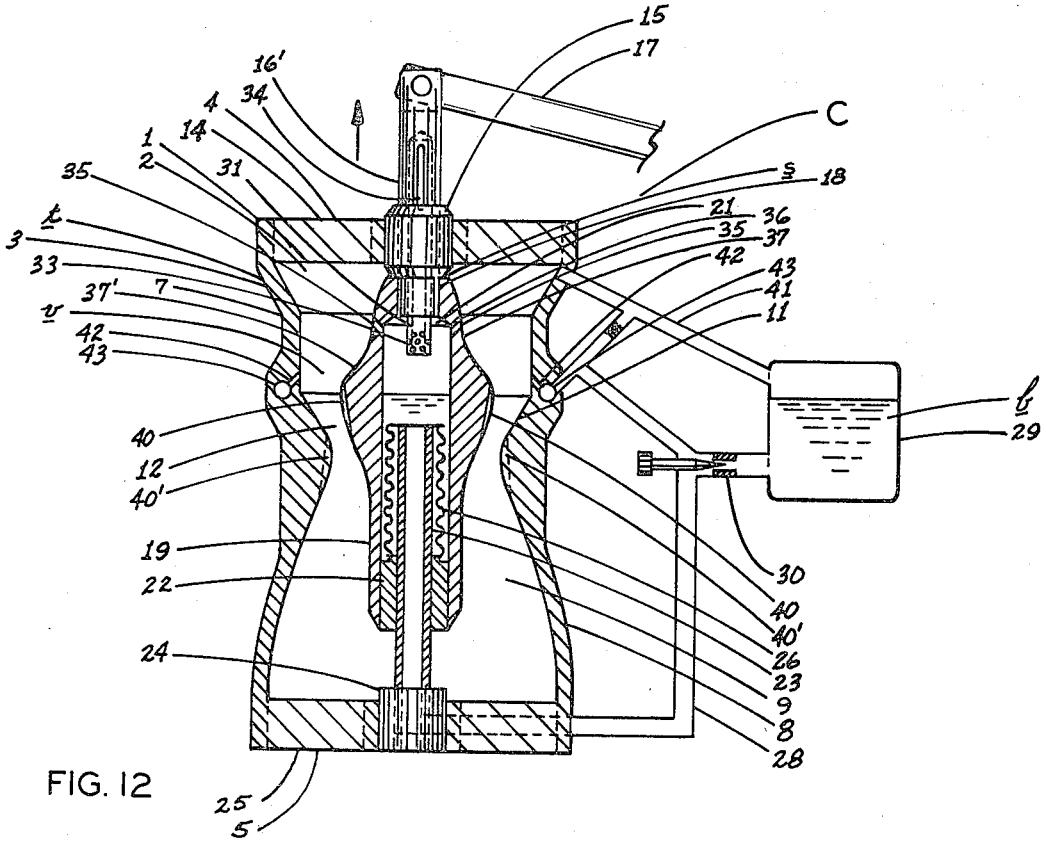
FIG. 12 is a vertical transverse sectional view of the carburetor shown in FIG. 11 but illustrating the same under advanced throttle condition.
Figure 13:
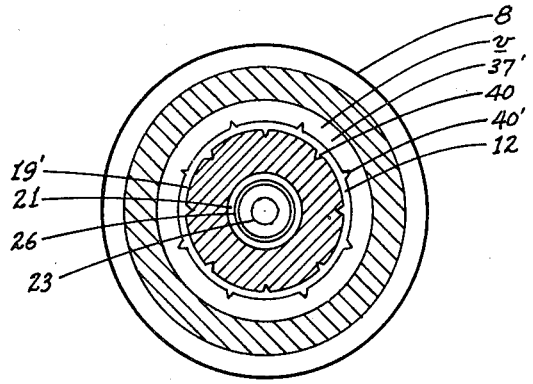
FIG. 13 is a horizontal transverse sectional view taken on the line 13—13 of FIG. 11.

Referring now to FIGS. 11, 12, and 13 a further form of carburetor indicated C, embodying the present invention is shown, and wherein components thereof corresponding to those of carburetor A bear like reference numerals for facilitating description. Carburetor C fundamentally differs from carburetor A in that in idle condition the associated plug 19 will be in full downward position (FIG. 11) with the lower end thereof resting upon lower spider bearing 24, and with sonic throat 12 being of minimum area with such plug 19 in lowered condition. Plug 19 is caused to ascend under actuation of the throttle linkage for meeting the power requirements as the engine operates at speeds above idling. Link 17 of the throttle linkage is pivotally engaged to the upper end of a control shaft 16' which is of constant diameter throughout its length and having a vertically extending narrow slot 34 which is located proximate the upper end of said shaft 16' for appropriate coordination with spider bearing 15 by reason of the direction of operation of plug 19'. It will also be observed that the upper end of fuel inlet pipe 23 is devoid of a check valve.

With carburetor C in idle position (FIG. 11) the volume of chamber 21 will be of minimal extent, but with air being drawn through venturi metering throat v, fuel f will be aspirated through ports 35. Throttle increase is achieved through upward movement of shaft 16' thus raising plug 19 causing an increase in the area of throat 12 (see FIG. 12) to accommodate the increased air flow rate and with the air velocity being proportionate, relatively increased quantities of fuel f will be drawn through ports 35. Pilot air for augmentation of fuel atomization and mixture is introduced into chamber 21 in the manner described hereinabove in conjunction with carburetor A, as slot 34 is progressively exposed for air introduction into pipe 31 as shaft 16' is elevated. It may be further observed that when plug 19 is raised venturi metering throat v is additionally restricted with concurrent widening of sonic throat 12 whereby air velocity is relatively advanced with attendant pressure decrease. The provision of indentations 40 and 40' on plug 19 and casing proturberance 11 bring about the same unusual and highly beneficial results as more fully discussed in conjunction with carburetor A above.

Figure 14:
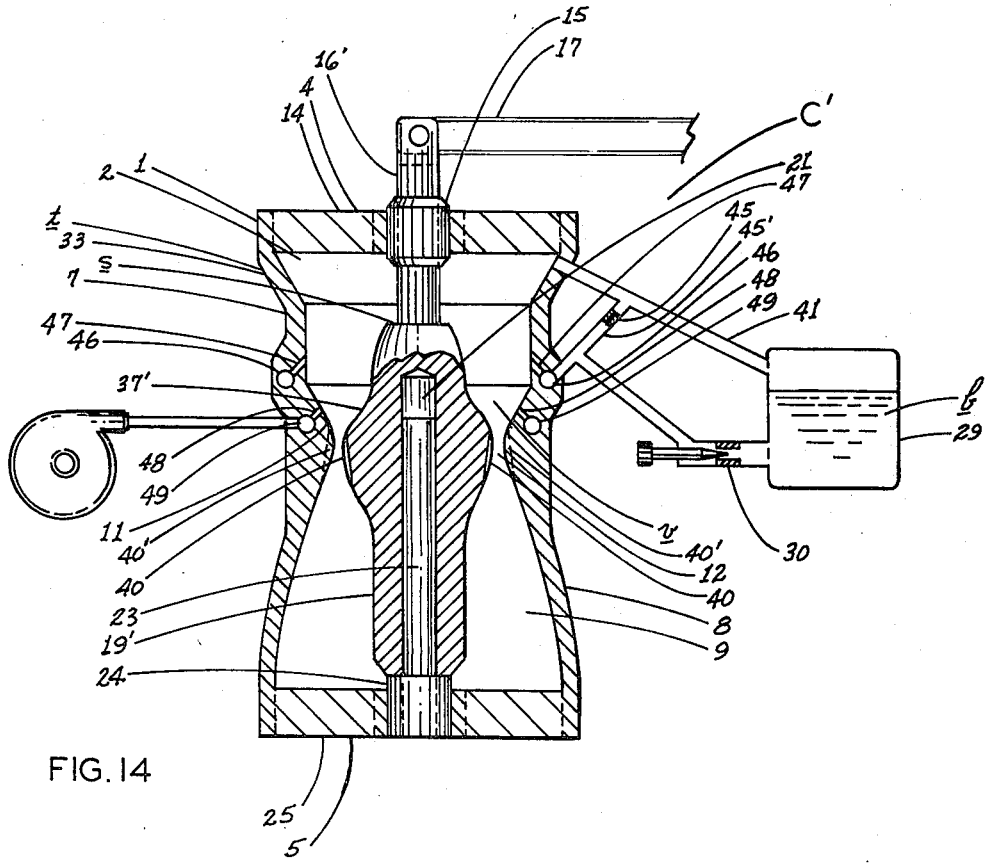
FIG. 14 is a vertical transverse sectional view of the carburetor shown in FIG. 11 illustrating an alternate manner of fuel introduction.
Figure 15:
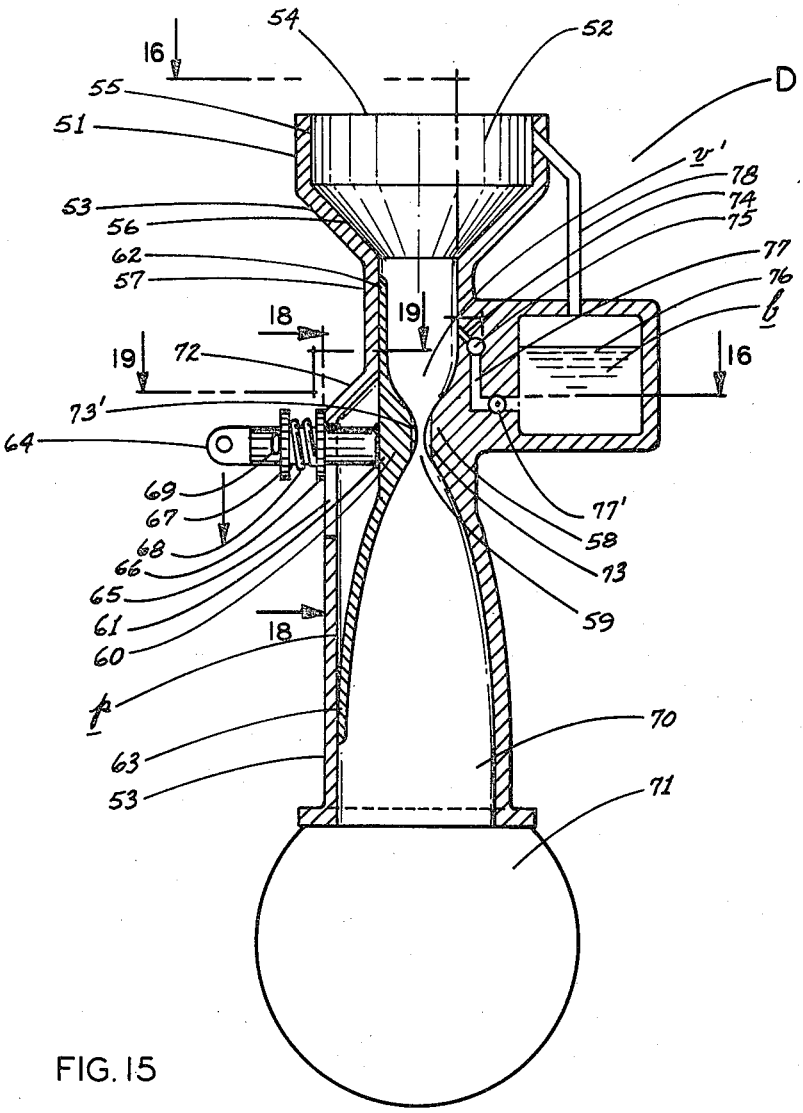
FIG. 15 is a vertical transverse sectional view of a further form of carburetor constructed in accordance with and embodying the present invention illustrating the same in idle position.

FIG. 14 illustrates a still further form of carburetor designated C' incorporating the present invention, which is of fundamentally like character as carburetor C so that like components will be indicated by like reference numerals. Carburetor C' comprises a solid plug 19' since the utilization of the plug as an accelerator pump is obviated in view of the integration of an alternate fuel supplying system. Carburetor C' includes a pilot air jet 45 within a conduit 45' connecting air vent line 41 with a manifold 46 provided in carburetor casing side wall 3, in the upper portion of waist 7; said manifold 46 communicating with the adjacent inner face of casing side wall 3 and hence venturi metering throat v through a multiplicity of circumferentially arranged ports 47. Pors 47 incline upwardly to provide the desired momentum to the fuel aspirated therethrough by the correspondingly reduced pressure of the high velocity air moving through venturi metering throat v. Also provided within casing side wall 2 is a second series of circumferentially arranged fuel ports 48, located downwardly of ports 47 but above proturberance 11, and being inclined upwardly for injection of fuel into the lower zone of venturi metering throat v and immediately above sonic throat 12. Ports 48 are connected to a manifold 49 formed within casing side wall 2 and extending thereabout; there being a suitable connection between said manifold 49 and a conventional accelerator pump (not shown) actuated through a suitable engagement to control linkage 17 in accordance with well known systems.

Accordingly, by means of the operation of said pump an increased quantity of fuel is introduced to venturi throat v upon manipulation of the carburetor throttle to assure of requisite air-fuel mixture during the initial interval of acceleration wherein the relative quantity of fuel f normally lags with respect to the quantity of air flowing through the carburetor.

Thus, carburetor C' provides the same result as carburetor B with respect to flow stability and mixture uniformity by incorporation of indentations 40 and 40' but involves a different manner of introducing fuel to the air flow.

Referring now to FIGS. 15–19, inclusive, another form of carburetor, indicated at D, and embodying the present invention is illustrated, and, being of the sonic throat type, is adapted for variation in extent of such throat by a sliding block nozzle arrangement as will be described. Carburetor D embodies a casing 51 having a bore generally denoted 52 and a side wall 53 which latter at its upper end is contoured to provide an inlet 54 with an upper, substantially wide cylindrical portion 55 and an inwardly tapering lower section 56 therebelow, which latter constitutes a transistion zone from circular cross-section to quadrilateral, but preferably rectangular, cross-section of a central or waist section 57. The upper portion of waist 57 constitutes a venturi throat v' by reason of the relatively reduced cross-sectional area. At the lower end of venturi metering throad v' in one side portion thereof, casing side wall 53 is formed to provide a rigid inwardly protruding portion 58 for developing one side of a narrow, elongated, linearly progressing sonic throat 59. The other side of said throat 59 is provided by a block 60 of complementary form to said protrusion 58. Block 60 is integral with a vertically slideable body 61 having upper and lower extensions, as at 62,63, respectively, for normal disposition on their outer faces against the confronting inner face portions of carburetor casing side wall 53 for relative movement with respect thereto in a direction lengthwise of carburetor D for purposes presently appearing. Rigid with slide body 61 and projecting from the outer face of block 60 thereof is a throttle actuator arm 64 which extends through an enlarged opening 65 in casing side wall 53 and outwardly of the latter carries spaced apart collars 66,67 against the opposed faces of which bear the opposite ends of a compression spring 68 surrounding said arm 64. A cotter pin 69 extends transversely through arm 64 and bears against the outer face of collar 67 to assure of maintenance of spring pressure against collar 66 which is thus urged against the outer face of carburetor side wall 53 adjacent opening 65, with attendant urging of block 60 into throat-forming relation with protrusion 58. At its outer extremity arm 64 is suitably engaged to throttle linkage (not shown) which is designed to cause arm 64 to be moved upwardly and downwardly within opening 65 for effecting corresponding vertical movement of slide body 61. As will be seen in FIG. 18 opening 65 is of such extent as to allow for facile movement therethrough of arm 64 while still presenting an adequate adjacent surface for bearing thereagainst of spring biased collar 66.

It will be seen that slide body extension 63 is formed on a relatively shallow arc which complements the contour of the adjacent portions of side wall 53 so as to define therewith a diffuser section 70 which is expanding volume downwardly toward the outlet which communicates with the intake manifold as indicated generally at 71. Said slide body extension 63 on its outer surface rides against a substantially vertical portion p of side wall 53, incorporating opening 65, which side wall at its upper end adjoins rectangular waist section 57 through an upwardly and inwardly inclined section 72.

Figure 16:
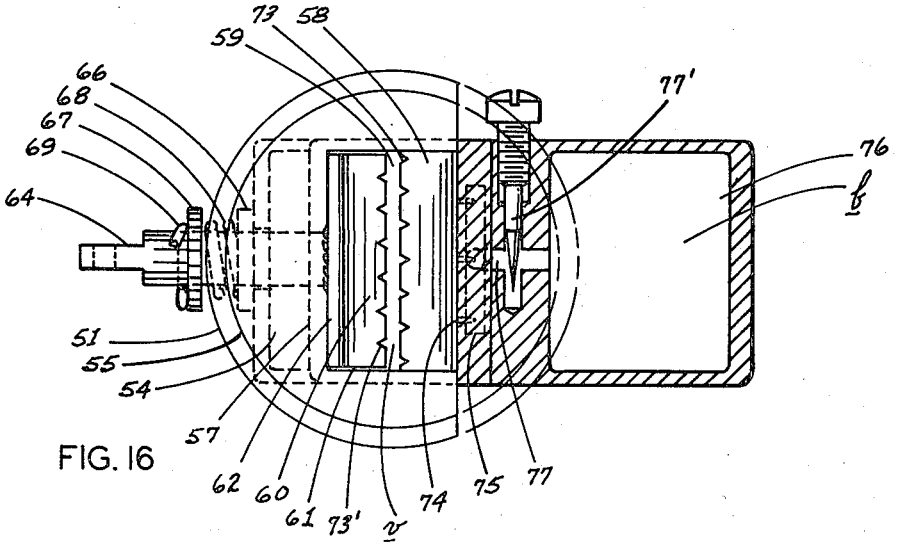
FIG. 16 is a horizontal transverse sectional view taken on the line 16—16 of FIG. 15.
Figure 17:
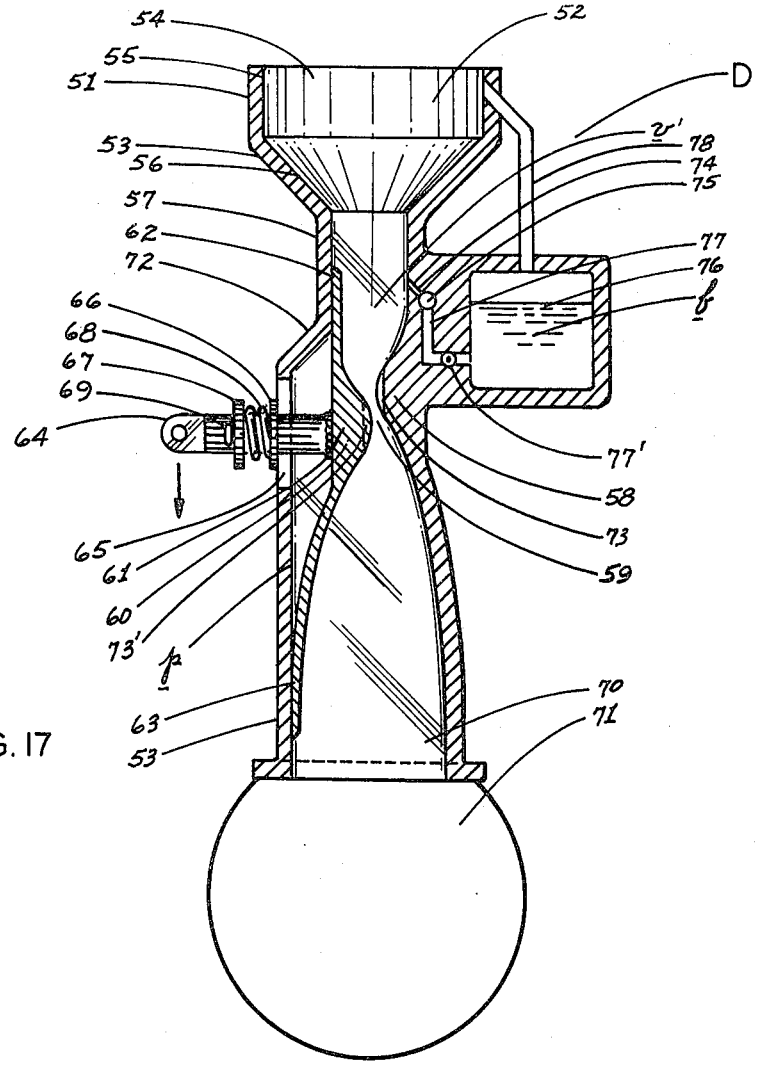
FIG. 17 is a vertical transverse sectional view of the carburetor illustrated in FIG. 15 but showing same in advanced throttle condition.
Figure 18:
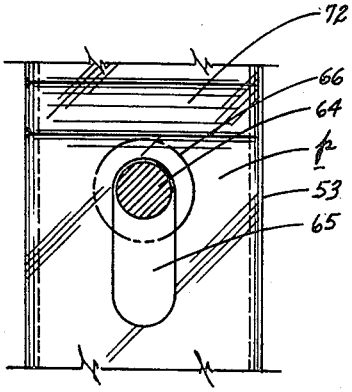
FIG. 18 is a vertical transverse sectional view taken on the line 18—18 of FIG. 17.
Figure 19:
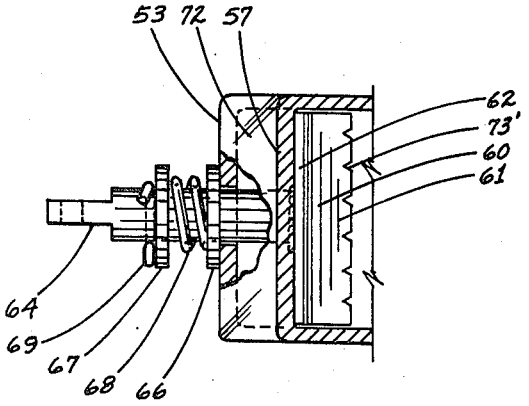
FIG. 19 is a horizontal transverse sectional view taken on the line 19—19 of FIG. 15.

The confronting faces of protrusion 58 and block 60 are provided with a multiplicity of vertically extending indentations 73,73', respectively, spaced apart lengthwise of said protrusion 58 and block 60, respectively, and are in mutually offset relationship (see FIG. 16). Indentations 73,73' serve the same function as indentations 40,40' hereinabove described in conjunction with carburetor A, that is, primarily for stabilizing flow and promoting intermixture. Although indentations 73,73' are shown as being provided on both protrusion 11 and block 60, respectively, it should be understood that the provisions of such indentations on either one of said surfaces alone will serve to promote the desired purpose. It is evident that the area of sonic throat 59 is controlled by the up and down movement of throat actuator 64 in the horizontal disposition thereof, by operation of throttle linkage (not shown). As the power requirements of he related vehicle dictate, arm 64 will e lowered within opening 65 thereby causing a downward sliding of slide body 61 with a widening of sonic throat 58, as shown in FIG. 17, for accommodating the increased air fuel flow.

Formed within the wall of central section 57 upwardly of sonic throat 58 is a series of peripherally disposed fuel emitting ports 74, the axes of which incline upwardly and inwardly from a manifold 75 communicating with a fuel chamber 76 through a conduit 77. Provided within conduit 77 is a needle valve 77'. Fuel chamber 76 is connected with the upper fuel inlet end 54 of carburetor D by means of a vent pipe 78.

Thus, air flow through venturi metering throat v' will cause aspiration of fuel f from fuel supply manifold 75 and thence outwardly through the fuel emission ports 74 for reception in particle form within the venturi air stream. The fuel-air mixture is then drawn through the critical sonic throat 58 wherein the fuel particles are atomized and evaporation is promoted. Pressure recovery is obtained in the diffuser section 70 under engine operating conditions of low manifold vacuum. Under conditions of high engine manifold vacuum the flow of the fuel-air mixture will expand super-critically downstream of throat 58 and will be shocked back to subsonic flow with a loss of total pressure to provide the necessary operating manifold vacuum. The supersonic flow and the accompanying shock waves will further conduce to the atomization and evaporation of the fuel fed to the combustion chambers.

Flow in the large aspect ratio rectangular sonic throat 58 and the flow downstream through diffuser section 70 are inherently unstable tending to separate at a transverse location productive of a maldistribution of flow in intake manifold 71. This condition is overcome by the said indentations 73,73' all above described.

Figure 20:
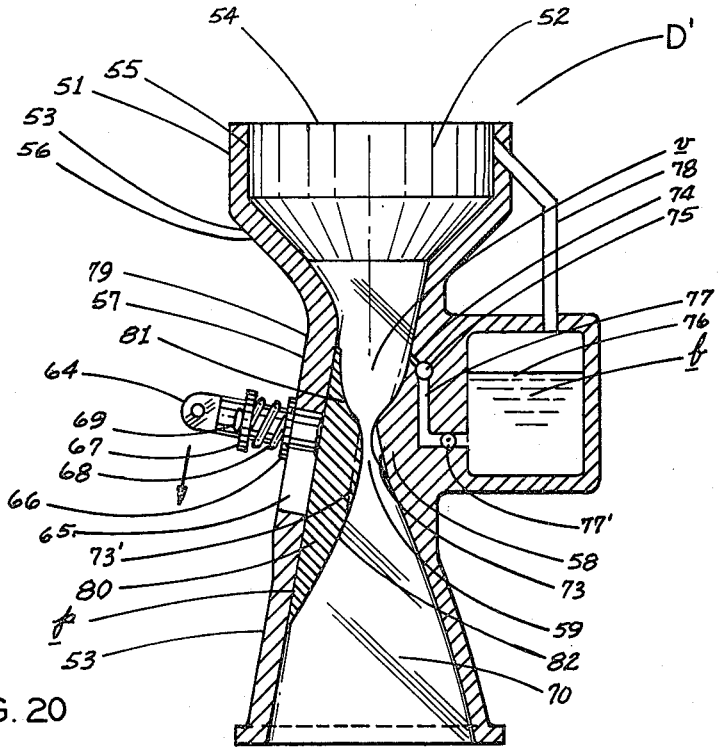
FIG. 20 is a vertical transverse sectional view of an additional form of carburetor constructed in accordance with and embodying the present invention illustrating same in idle condition.
Figure 21:
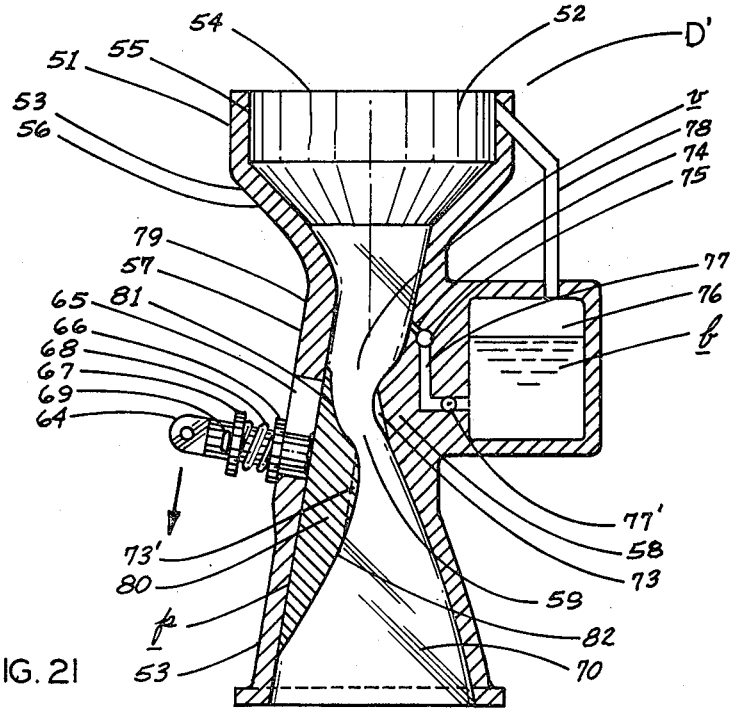
FIG. 21 is a vertical transverse sectional view of the carburetor shown in FIG. 20 but illustrating same in advanced throttle condition.
Figure 22:
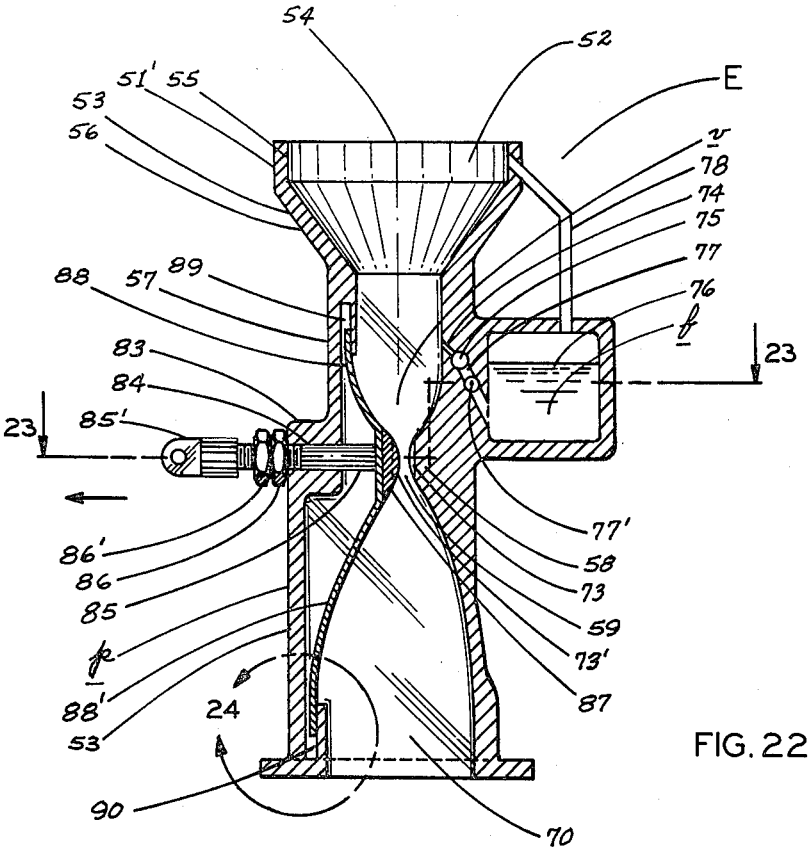
FIG. 22 is a vertical transverse sectional view of a further form of carburetor constructed in accordance with and embodying the present invention illustrating same in idle position.
Figure 23:
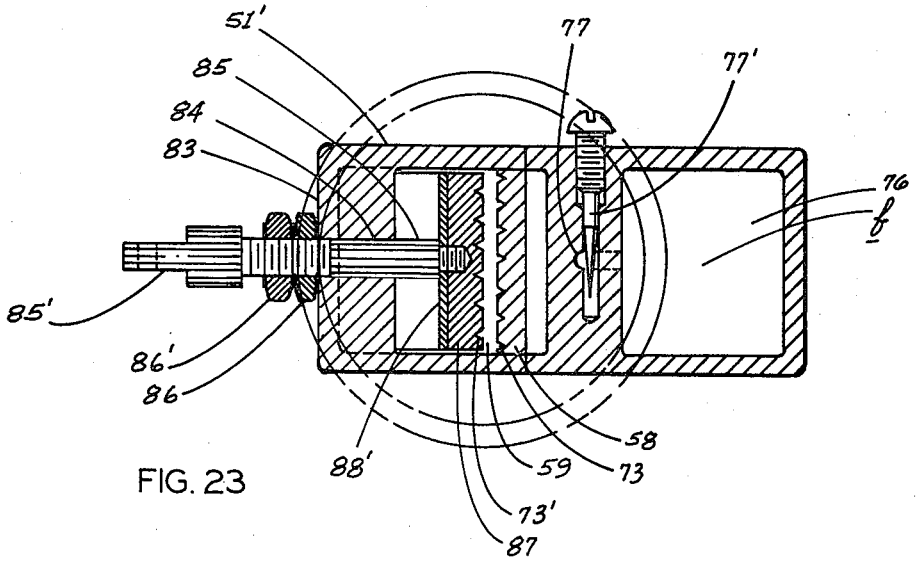
FIG. 23 is a horizontal transverse sectional view taken on the line 23—23 of FIG. 22.
Figure 24:
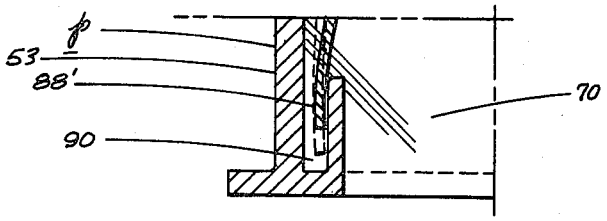
FIG. 24 is a vertical transverse sectional view taken on the line 24—24 of FIG. 22.
Figure 25:
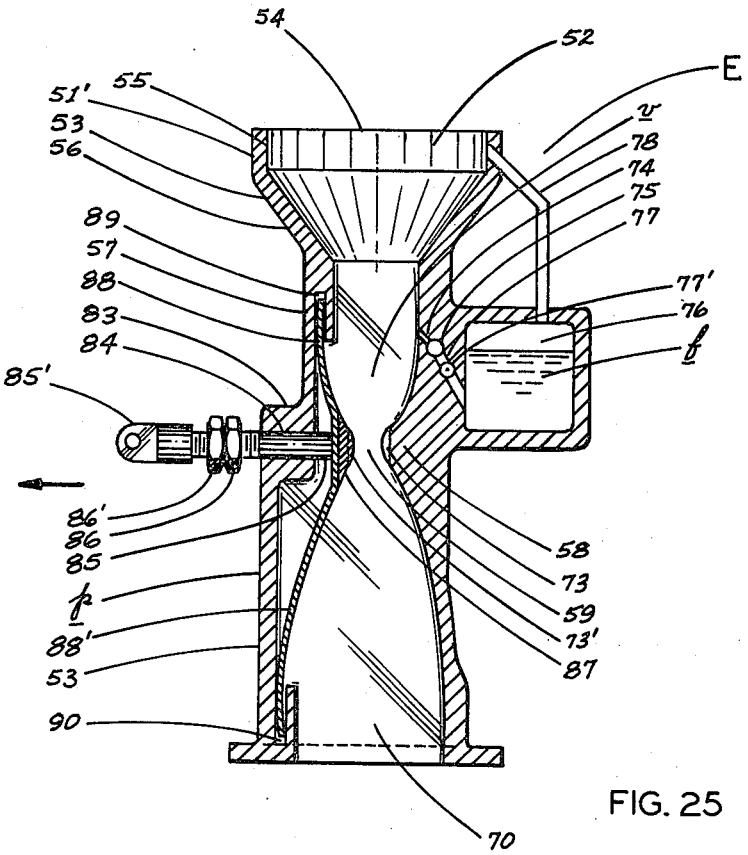
FIG. 25 is a vertical transverse sectional view illustrating the carburetor shown in FIG. 22 in advanced throttle condition.

FIG. 20 illustrates a still further form of carburetor indicated D', embodying the present invention which is constructed along the basic lines of carburetor D so that like elements will be designated by the same reference characters. In carburetor D' it will be seen that casing side wall 53 downwardly of tapering section 56 within one portion thereof, as indicated at 79, inclines downwardly and outwardly toward its lower end, and substantially centrally of its length is provided in one side portion with opening 65 for projection therethrough of the inner end of arm or throttle actuator 64, which latter at its inner end extremity is rigidly secured to the outer face of a slide body 80. Slide body 80 is uniquely contoured on its upper inner face to provide a suitably curved portion 81 for cooperation with the adjacent fixed portions of casing 51 coordinating therewith to define venturi metering throat v' which as developed hereinabove is of rectangular cross-section. Downwardly of curved portion 81 said slide body 80 is contoured to present an inwardly directed surface 82 defining one side portion of rectangular sonic throat 59 and having indentations 73' formed thereon, which by reason of the contouring of slide body 80 will be in a slightly downward and outward disposition. Similarly, the indentations 73 on protruding portion 58 are of like character as to also incline slightly downwardly and outwardly in mutual diverging relationship to indentations 73'. The lower portion of slide body 80 bears an appropriate configuration for cooperating with the adjacent portions of casing 51 to define the expanding diffuser section 70. Thus, just as in the same manner as carburetor D, the area of sonic throat 59 is altered by downward travel of arm 64 so as to accommodate increased flow (see FIG. 21) and with indentations 73,73' functioning for the purposes above described. In this particular embodiment it is to be observed that the movable component of sonic throat 59, that is, slide body 81, moves in a vertically inclined path, rather than a substantially vertical path.

Reference is now made to FIGS. 22–25, inclusive, which illustrate another form of sonic flow carburetor, indicated E, embodying the present invention. Carburetor E comprises a construction immediately related to that of carburetor D above described so that like reference characters will be utilized to identify like components.

Carburetor E incorporates a casing 51' which differs from casing 51 above in that the vertical portion p' in the zone of joinder with waist section 57 forms a boss 83 having an opening therethrough 84 constituting a bearing for a horizontally reciprocally slideable throttle actuator rod 85, the outer end of which is suitably engaged to throttle linkage (not shown). Mounted on externally threaded stem portion 85' of rod 85 outwardly of casing portion p' is a pair of jam nuts 86,86' which serve as stops or abutments for limiting the projection of rod 85 inwardly of casing 51'. At its inner end rod 85 is fixed, as by threading, to the outer face of an elongated element 87 axially parallel to rod 85 and the inner face of which is convex for providing one side of sonic throat 59 in confronting relation to casing protrusion 58. Element 87 is integrated with an upper and a lower extension 88, 88', respectively, of preferably metallic sheet stock, the upper and lower end extremities, respectively, of which are accepted within downwardly and upwardly opening guide pockets 89, 90, respectively, formed integrally with casing side wall 53 in the upper portion of waist 57 and the lower end of diffuser section 70, respectively. Said pockets 89,90 are of sufficient depth so as to retain the respective engaged portions of said extensions 88,88' but yet permit relative slideable movement of the same therein in accommodating for the inward expansion and outward contraction consequent to movement of rod 85.

Accordingly, it will be seen that sonic throat 59 is varied in area commensurate with the velocity of the flow therethrough in accordance with the fuel requirements of the engine in operating at speeds above idling by means of the outward pulling of rod 85 through suitable actuation of the throttle linkage whereby said element 87 will be commensurately drawn away from protrusion 58, thereby widening the intervening gap or throat 59. As with carburetor D above, said sonic throat 59 is of generally rectangular configuration as is the venturi metering section v' thereabove. The flow stabilizing and uniform mixture producing indentations 73' may be formed on element 87 for cooperation with indentations 73, and being in mutual offset relation thereto.

Figure 27:
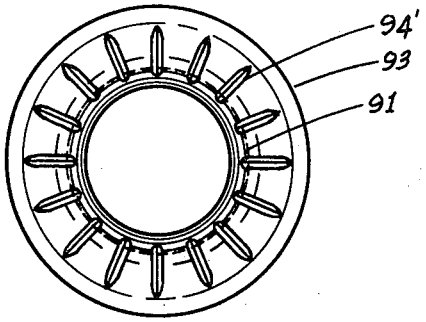
FIG. 27 is a horizontal transverse sectional view taken on the line 27—27 of FIG. 26.
Figure 26:
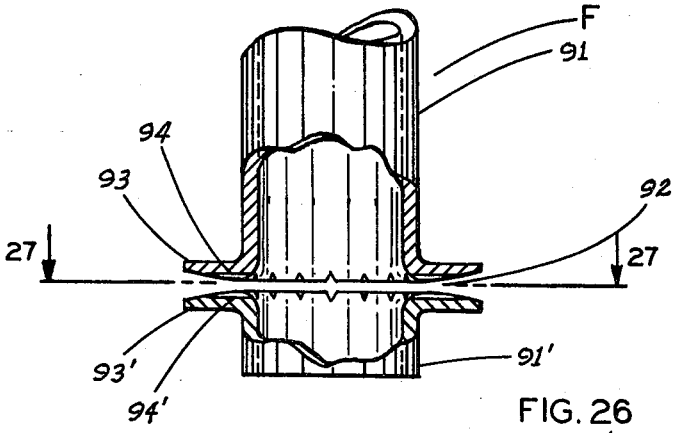
FIG. 26 is a vertical transverse sectional view of a horizontally arranged sonic throat.

Referring now to FIGS. 26 and 27, F indicates fragmentarily a portion of a carburetor casing as of tubular character and being annular in cross-section, which casing F incorporates cooperating portions 91,91' defining therebetween, a sonic throat 92 which provides for radial flow therefrom. Said throat 92 is defined by opposed extensions or flanges 93, 93' at the adjacent ends of cooperating portions 91,91', respectively, which on their confronting faces embody flow stabilizing indentations 94,94' which are arranged throughout the extent of the respective flanges. Said indentations 94,94' are circumferentially spaced but with their axes projecting radially and with said indentations serving the same function as indentations 40,40' above described. By expedients not shown sonic throat 92 may be increased in cross-section by movement of one portion 91 or 91' relative to the other, cooperating portion.

Figure 28:
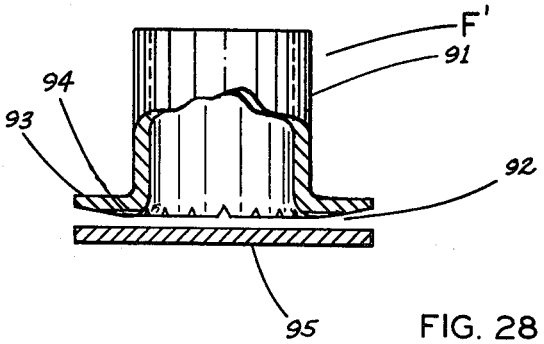
FIG. 28 is a partial vertical transverse sectional view of another form of horizontally arranged sonic throat constructed in accordance with and embodying the present invention.

Referring to FIG. 28 there is illustrated a carburetor casing F' for a sonic throat of the type shown in FIG. 26 so that like reference numberals will indicate like components but wherein a continuous wall forming component 95 replaces cooperating portion 91' of casing F above described so that portion 91 will be adapted for movement toward and away from casing wall 95 for engine fuel requirements. It is thus to be understood that FIGS. 25, 26, and 27 merely illustrate by partial drawings the applicability of the present invention to carburetors having sonic throats of annular design with such throats being adjustably responsive to throttle action and with the indentations being presented for conducing to flow stability and uniformity of air-fuel mixture.

Figure 29:
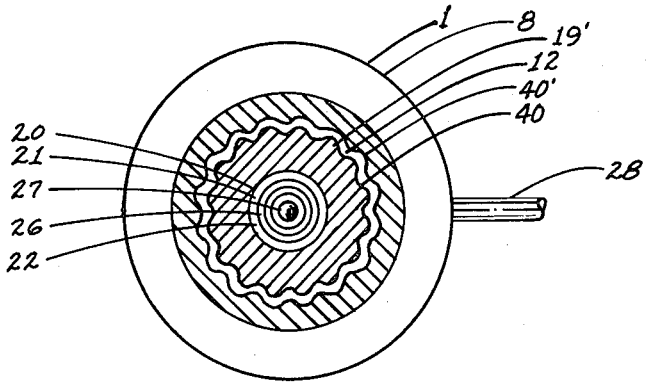
FIG. 29 is a horizontal transverse sectional view taken substantially on the line 5—5 of FIG. 1 but illustrating another form of sonic throat contour.

Hereinabove with the various carburetors disclosed, portions, or the entireties, of the walls defining the sonic throat have been provided with indentations as indicated at 40, 40', 73,73', 94,94', which serve to stabilize the flow and to promote even fuel mixture, all as fully described. In lieu of such indentations, if desired, the sonic throat walls may be provided with a series of projections, as indicated at 40,40' in FIG. 29. The projections 140 being provided on one wall of the particular sonic throat, and the projections 40' which are in alternating relationship with projections 40, may be formed on the other or opposing wall of the particular sonic throat. Just as in the case of the described indentations such projections may be provided on only one wall of the throat or both walls. Projections 40,40' thus extend outwardly from the outside surface of the particular wall and may be relatively sharp or of a more rounded nature if preferred. It is, therefore, to be understood that the pattern of projections may be used instead of the indentations and with equally effective flow stabilization and promotion of fuel mixture. However, it is believed that from a production standpoint, the provision of the indentations might be more economical.

Figure 30:
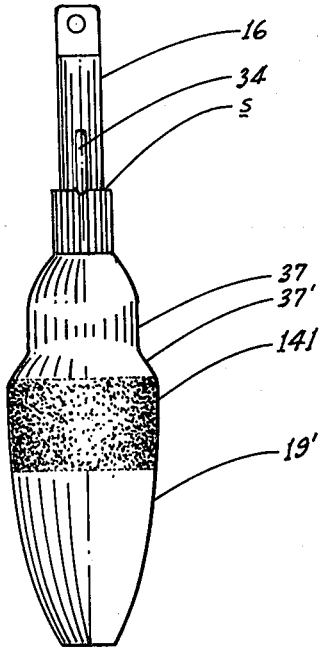
FIG. 30 is an exterior elevational view of the plug shown in FIG. 7 but incorporating a still further form of sonic throat surface contour.

In FIG. 30 there is shown an elevational view of plug 19' which in all respects conforms to plug 19 above described, except that it is devoid of indentations 40 and instead is provided on its outer surface with a discrete surface roughened zone, as at 141. Said zone 141 may be effected in any suitable manner, such as by shot peening, glass bead peening, etc., so as to produce an irregular surface. Such surfaces, as at 141 are thus capable of endowing the related sonic throat with flow stabilization by inducing turbulence. With this modification as well, one or both walls of the sonic throat may be rendered irregular or roughened. It is to be understood that the provision of such irregular surfaces is not restricted to carburetors embodying plugs, such as 19', as the same is illustrated merely for exemplary purposes. The roughened zones 141 may replace indentations 40,40', 73,73', and 94,94' as well as the projections broadly designated above 140,140'.

Figure 31:
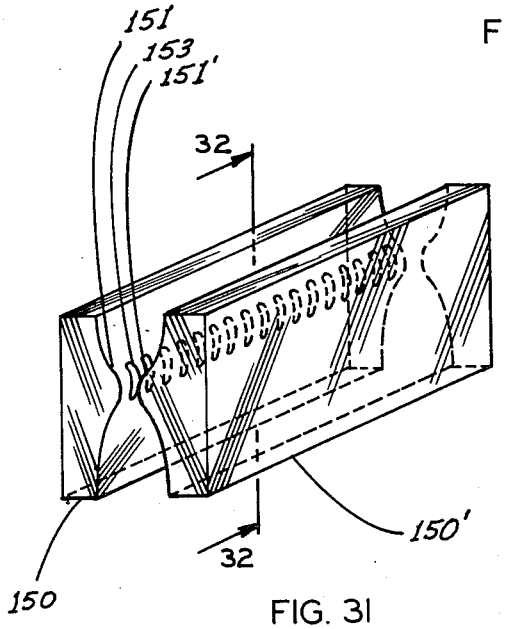
FIG. 31 is a perspective view, generally schematic, of a sliding block nozzle.
Figure 32:
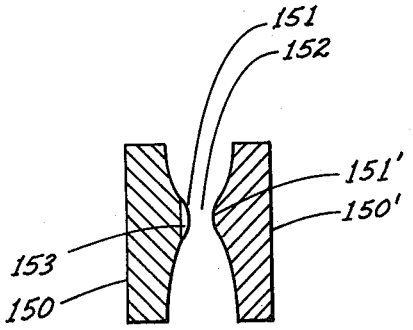
FIG. 32 is a vertical transverse sectional view taken on the line 32—32 of FIG. 31.

FIGS. 31 and 32, in a substantially schematic manner, disclose the present invention in flow stabilizing means as adapted for use with a sliding block nozzle which is of conventional design incorporating cooperative blocks 150, 150' being provided on their confronting faces with substantially centrally located protrusions 151,151', for defining therebetween a sonic throat 152. Provided on protrusion 151 through its extent are spaced apart indentations 153 which are in all respects similar to indentations 40 above described. Protrusion 151' also may be provided with similar indentations but as such is optional only indentations are shown on block 150. In accordance with the foregoing it should be understood that indentations 153 may, if preferred, be replaced by projections or by a roughening or irregularity of the surfaces of either or both of said protrusions 151,151'. Blocks 150,150' are adapted for relative movement for altering the volume of the sonic throat 152 responsively to operational demands of the carburetor.

Having described my invention, what I claim and desire to obtain by Letters Patent is:

1. A carburetor comprising means defining an elognated casing having opposed ends with an air inlet provided at one end and an air-fuel mixture outlet provided at the other end, wall forming means provided in said casing between said inlet and said outlet defining a restricted passage constituting a single sonic throat for flow therethrough of air and entrained fuel, flow stabilizing means disposed on said throat, a diffuser section below said throat and connecting same with said air-fuel mixture outlet, said sonic throat being comprised of first and second coordinating wall forming components, said first component being fixed, said diffuser section having a wall of downwardly and outwardly tapering configuration, a slide body for movement upwardly and downwardly along said diffuser section, said second sonic throat component being defined by said slide body, means for moving said slide body between a first position wherein said first and second sonic throat components are in confronting relationship and a second position wherein said first and second components are offset with respect to each other with one being located relatively outwardly and downwardly of the other as being determined by the taper of said diffuser section so that said first and second components are relatively movable within a converging-diverging path for varying the cross-sectional area of the throat consequent to carburetor operational demands.

2. A carburetor comprising means defining an elongated casing having opposed ends with an air inlet provided at one end and an air-fuel mixture outlet provided at the other end, wall forming means provided in said casing between said inlet and said outlet defining a restricted passage constituting a single sonic throat for flow therethrough of air and entrained fuel, said casing having a fuel inlet located spacedly above said sonic throat, flow stabilizing means disposed on said throat, a diffuser section below said throat and connecting said with said air-fuel mixture outlet, said sonic throat being comprised of first and second coordinating wall forming components, said first component being integral with said casing for fixed positioning, said diffuser section of said casing having a wall of downwardly expanding configuration tapering downwardly and outwardly, a slide body for movement lengthwise of said casing along the diffuser wall thereof, said second sonic throat component being provided on said slide body, means for moving said slide body from upward position wherein said first and second sonic throat components are in confronting relationship to downward position wherein said second component is located outwardly and downwardly of said first component with the path of travel of said slide body being determined by the taper of said diffuser section so that said first and second components are relatively movable within a converging-diverging path for varying the cross-sectional area of the throat consequent to carburetor operational demands.

* * * * *

UNITED STATES PATENT OFFICE

CERTIFICATE OF CORRECTION

Patent No. 4,280,969 Dated July 28, 1981

Inventor(s) Wilbur M. Swanson

It is certified that error appears in the above-identified patent and that said Letters Patent are hereby corrected as shown below:

Column 14, Claim 2, Line 30, "said" (second occurrence) should be ---same---.

Signed and Sealed this

Sixth Day of October 1981

[SEAL]

*Attest:*

GERALD J. MOSSINGHOFF

*Attesting Officer* *Commissioner of Patents and Trademarks*